US006394869B1

(12) United States Patent
Haugaard et al.

(10) Patent No.: US 6,394,869 B1
(45) Date of Patent: May 28, 2002

(54) METHOD FOR MANUFACTURE OF OVERHEAD LIGHT FIXTURE

(75) Inventors: Eric Haugaard, Kenosha, WI (US); Kurt Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 09/696,545

(22) Filed: Oct. 24, 2000

(51) Int. Cl.[7] ..... F21V 17/12; F21V 19/00; F21W 131/40; F21Y 101/00

(52) U.S. Cl. ..... 445/23; 362/147; 362/295; 362/368

(58) Field of Search ..... 445/23, 22; 362/147, 362/148, 221, 265, 296, 304, 368

(56) References Cited

U.S. PATENT DOCUMENTS 5,032,959 A * 7/1991 Brass ..... 362/147
5,138,528 A * 8/1992 Altman et al. ..... 362/265

* cited by examiner

*Primary Examiner*—Kenneth J. Ramsey
(74) *Attorney, Agent, or Firm*—Jansson, Shupe & Munger, Ltd.

(57) ABSTRACT

A method for making an overhead light fixture includes forming top and bottom housing members, the top member having a horizontal top wall with fastener-receptors therein and an inside surface, and the bottom member being engageable with the top member, placing the top member on a work support structure in inverted orientation, placing each of the power-related components on the top-wall inside surface, securing the power-related components to the inside surface by engagement of fasteners in a common direction with a set of the top-wall fastener-receptors, placing the bottom member on the top member in inverted orientation and securing them together securing the bottom member to the top member, and removing the fixture from the support structure. Unidirectional fastener attachment is used for the securing steps in assembly, including with respect to attachment of a socket mount, and with respect to attachment of the top and bottom housing members.

20 Claims, 9 Drawing Sheets

METHOD FOR MANUFACTURE OF OVERHEAD LIGHT FIXTURE

FIELD OF THE INVENTION

This invention is related generally to overhead industrial light fixtures and the manufacture thereof.

BACKGROUND OF THE INVENTION

A wide variety of overhead industrial light fixtures exist to serve needs such as factory and warehouse illumination and the like, and a number of advances have been made over the years. However, existing overhead industrial light fixtures have a number of problems and shortcomings, and it is to addressing such problems and shortcomings that this invention is directed.

One concern is that certain overhead industrial light fixtures of the prior art are unwieldy in size and shape, which makes their manufacture difficult and expensive. More generally, high cost and complexity of manufacture are problems of particular importance to manufacturers.

In the prior art, a variety of overhead industrial light fixtures are made using expensive die cast housings, and in some cases, complex housings are used to achieve various ends. In some cases, various external parts are required in order to support the electrical components; such structures once again, do not lend themselves to a pleasing appearance in an overhead industrial light fixture.

This invention addresses such problems and shortcomings.

OBJECTS OF THE INVENTION

It is an object of this invention to provide an improved method for manufacture of overhead industrial light fixtures which overcomes some of the problems and shortcomings of the prior art.

Another object of this invention is to provide a simple manufacturing method for an overhead industrial light fixture which has all components enclosed within a single housing.

Another object of this invention is to provide a simple manufacturing method for an overhead industrial light fixture which has a low profile, and which is compact and pleasing in appearance.

Another object of this invention is to provide a simple manufacturing method for an overhead industrial light fixture which is free of any external power-related components and component support structure.

Another object of this invention is to provide a simple manufacturing method for an overhead industrial light fixture which does not involve use of an expensive die cast housing.

These and other objects of the invention will be apparent from the following descriptions and from the drawings.

SUMMARY OF THE INVENTION

The invention is a method for manufacture of overhead industrial light fixtures of the kind which include a housing, power-related components (e.g., a ballast, a capacitor and an ignitor) secured within the housing, and a socket on a socket mount secured to the housing. The method of this invention is an improvement over prior art manufacturing methods for such light fixtures.

The method of this invention includes the following steps.

Before assembly begins, a housing top member is formed, such top member having a horizontal top wall (having one or more portions) with fastener-receptors therein and an inside surface. Likewise, a housing bottom member is formed for fitted engagement with the top member. Then, with the power-related components and any other components at hand, assembly proceeds.

Assembly involves placement of the top member in generally inverted orientation on a work support structure, with the inside surface of the top member facing upwardly. Then, each power-related component, e.g., the ballast, capacitor and ignitor, is placed on the upwardly-facing top-wall inside surface generally in its intended position. These components are then secured to the inside surface of the top member by engagement of fasteners in a common direction with a set of the fastener-receptors in the top wall. In other words, fasteners are unidirectionally applied to attach these components to the inside surface of the top member.

Assembly continues by placing the bottom member on the top member in inverted orientation. Then the bottom member is secured to the top member to substantially complete assembly of the fixture. When assembly is completed, the fixture is removed from the support structure.

Preferred embodiments also include placing the socket mount on the top-wall inside surface, and thereafter securing the socket mount to the top-wall inside surface by engagement of fasteners in the common direction with another set of the top-wall fastener-receptors. The placing and securing steps with respect to the socket mount are most preferably at generally the same time as the placing and securing steps with respect to the power-related components.

In preferred embodiments, the securing of the housing bottom member to the housing top member is by engagement of fasteners in the common direction with additional fastener-receptors in the top member.

The top-member fastener-receptors are preferably threaded holes and the fasteners engaged therewith are screws.

In certain preferred embodiments, the housing bottom member has a horizontal bottom wall with an outside surface and a plurality of bottom-wall fastener-receptors therein, and the method further includes the steps of placing a reflector on the outside surface of the bottom wall in inverted orientation and securing the reflector to the bottom member by engagement of fasteners in the common direction with the bottom-wall fastener-receptors. All the above-referenced fastener engagement motions have been unidirectional and downward, which significantly facilitates manufacture. Preferably, the bottom-wall fastener-receptors are downward projections included in the bottom wall, and it is preferred that the forming of the bottom member include stamping to form the projections.

It is preferred that the forming of the top member include forming a central top-wall portion and a pair of lateral top-wall portions which are on opposite sides of the central top-wall portion and are vertically offset therefrom. The top-wall fastener-receptors are preferably on the lateral top-wall portions so that the securing of each of the power-related components, and the socket mount when that is likewise mounted, is by engagement of fasteners with the fastener-receptors on both of the lateral top-wall portions. When mounted in this manner, the power-related components are bridged between the lateral top-wall portions, across the central top-wall portion.

The forming of the top member preferably also includes forming downwardly-extending sidewall portions which are integral with the top-wall portions, such sidewall portions including two opposed endwalls each of which extends downwardly from the top wall and terminates in an end flange. The end flanges have additional fastener-receptors therein, preferably one for each flange. The forming of the bottom member includes forming a bottom wall and upwardly-extending sidewall portions which are integral with the bottom wall and which, together with the downwardly-extending sidewall portions, complete sidewalls for the housing. The bottom wall has fastener holes in it which are aligned with the fastener-receptors in the end flanges of the top-member sidewall portions, facilitating the aforementioned engagement.

Most preferably, the forming of the top member includes bending a piece of sheet metal to form the junctures between the top wall and sidewall portions thereof, and the forming of the bottom member includes bending another piece of sheet metal to form the junctures between the top wall and sidewall portions thereof Broadly, the method of this invention includes: (1) forming top and bottom housing members for fitted engagement with one another to form the housing, each of the housing members having a horizontal wall with an inside surface, the horizontal surface of a first of the housing members having fastener-receptors therein; (2) placing on a work support structure the first housing member with its inside surface facing substantially upwardly; (3) placing the power-related components on the inside surface of the first housing member and securing them thereto by engagement of fasteners in a common direction with a set of the fastener-receptors; (4) placing the second of the housing members on the first housing member in its fitted engagement therewith; (4) securing the second housing member to the first housing member to substantially complete assembly of the fixture; and (5) removing the fixture from the support structure.

Such broadly stated method preferably includes placing the socket mount of such light fixture on the inside surface of the first housing member and securing it thereto by engagement of fasteners in the common direction with another set of the fastener-receptors. As noted above, these placing and securing steps are preferably about concurrent with the placing and securing steps with respect to the power-related components. The securing of the second housing to the first housing, whether bottom to top or top to bottom, is preferably by engagement of fasteners in the common direction with additional fastener-receptors in the first housing member.

While it is highly preferred that the light fixture be assembled with its top and bottom members and all its components inverted, and that it is highly preferred that the components, including the power-related components be secured to the top member, manufacturing method, with its unidirectional fastening and assembly of components, can be carried out in other ways. For example, the components can be attached to the bottom member, which during assembly is on a support structure in its normal (non-inverted) orientation, In such case, the fastener-receptors would be in the bottom member. The preferred embodiment in which the socket is recessed within the housing can be accomplished by use of a U-shaped socket-mounting member which has the socket between the legs of the U-shaped member. After attachment of the components, the top member is then attached to the bottom member. All such fastening is unidirectional.

As used herein, the following terms have the meanings given below, unless the context requires otherwise:

In referring to an overhead industrial light fixture, the term "overhead" refers to fixtures which are typically mounted, directly or indirectly, on ceilings or overhead structural members of some sort, such as in factories, warehouses, etc. (regardless of purpose), or any other overhead structure put in place for the purpose of supporting a light fixture. The term "industrial" is used in order to differentiate from residential lighting or the like. Neither of these terms is to be taken as limiting.

The term "power-related components" includes ballasts, capacitors, ignitors and other devices for creating the proper electrical power usable for a selected lamp, such as high-intensity discharge (HID) lamps of various kinds.

The term "substantially enclosed," as used with respect to a space within a housing, means surrounded, but does not mean closed from the inflow and outflow of air. Indeed, as can be seen in the drawings, certain of the walls of the housing are heavily vented to allow essentially unrestricted inflow and outflow of air, for purposes of cooling. This invention involves enclosure of power-related components and recessing of the socket into the housing, and for these reasons cooling by convection flow is of great importance.

As used with respect to the socket, the term "substantially within" does not rule out protrusion of a small portion of the lamp-receiving end of the socket from the housing, through the socket window.

The term "low-profile" as applied to a lighting fixture means that the fixture is lower in profile than occurs when the socket is not recessed into the housing.

The terms "top" and "bottom" used herein with reference to the fixture, or parts thereof, assume the normal use orientation of the fixture.

The overhead industrial light fixture of this invention, in its various forms, overcomes certain problems and shortcomings of the prior art, including those referred to above.

BRIEF DESCRIPTION OF THE DRAWINGS

The drawings illustrate preferred embodiments which include the above-noted characteristics and features of the invention. The invention will be readily understood from the descriptions and from the drawings, in which.

DETAILED DESCRIPTION OF PREFERRED EMBODIMENTS

Figure 1:
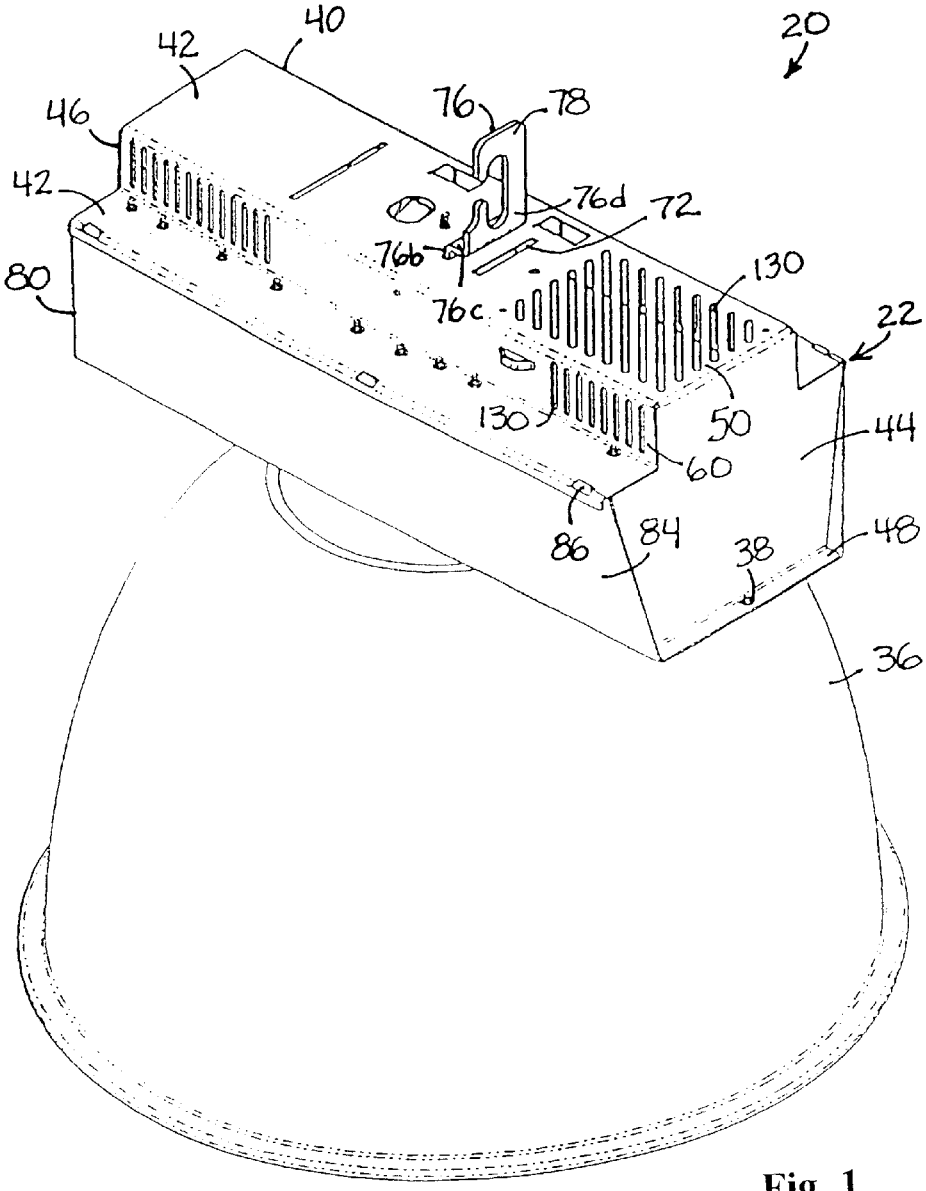
FIG. 1 is a perspective view of a preferred industrial light fixture in accordance with this invention.

The drawings illustrate an overhead industrial light fixture 20 made using the method of this invention. Light fixture 20 includes: a housing 22; power-related components including a ballast 24, a capacitor 26, and an ignitor 30; a capacitor mounting strap 28; a socket mount 32; a lamp-mounting socket 34; and a reflector 36. Such elements are best seen in FIGS. 2 and 12.

Figure 2:
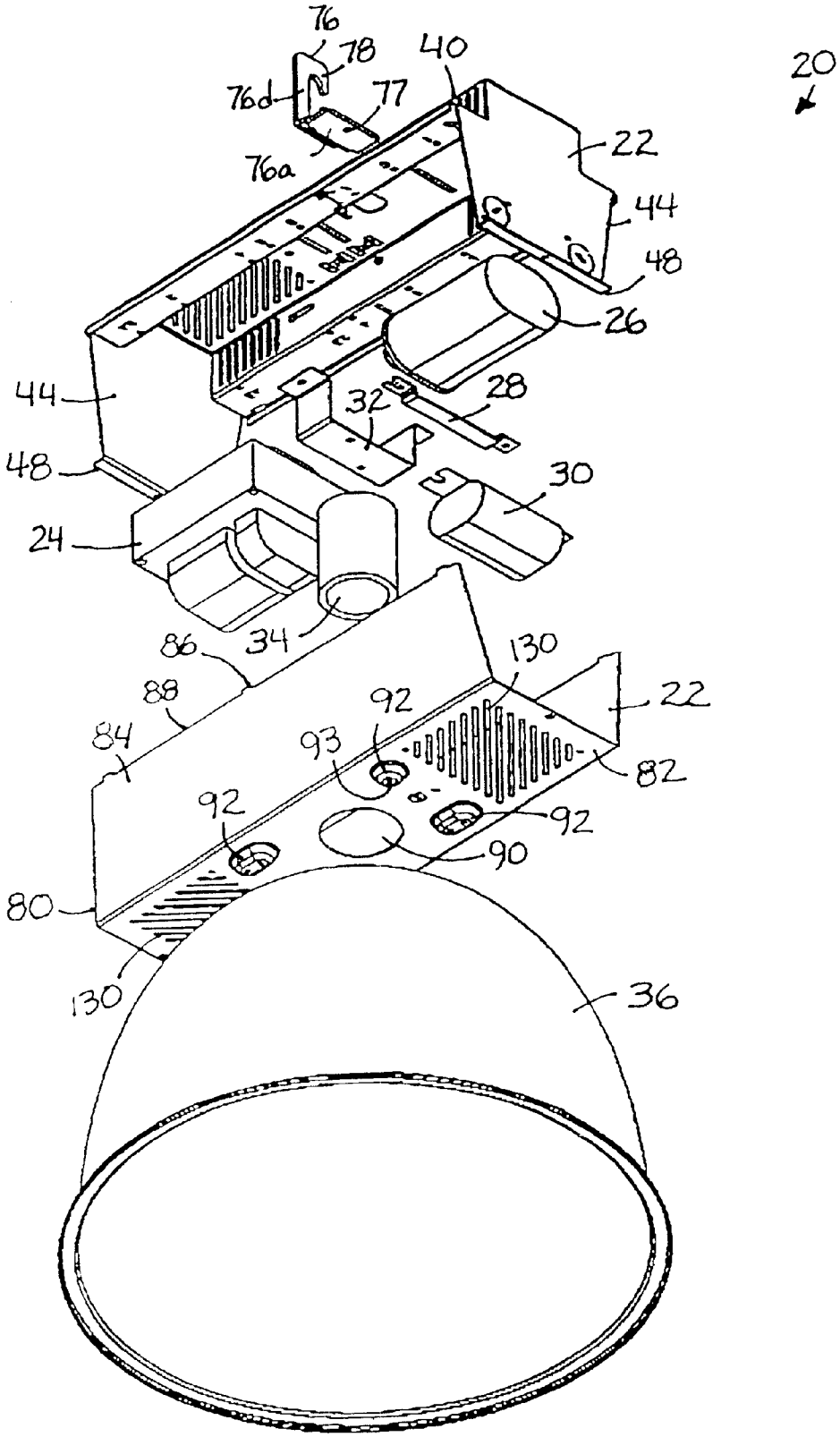
FIG. 2 is an exploded perspective view of the device of FIG. 1.
Figure 12:
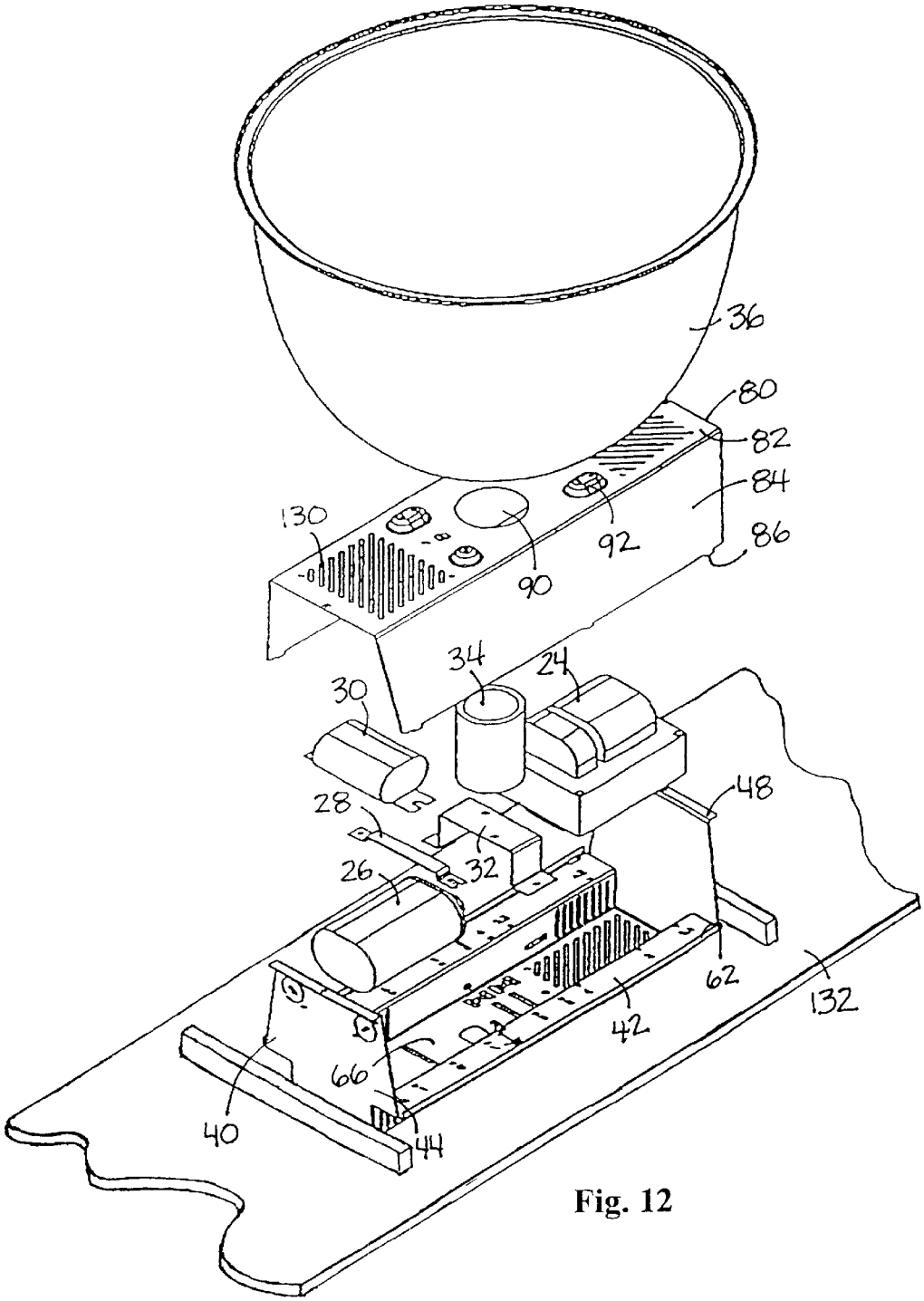
FIG. 12 is an exploded perspective view of the assembly of a device in accordance with this invention illustrating the method of manufacture.

Referring to FIGS. 1–2 and 12, housing 22 has enclosure-forming top and bottom members 40 and 80, respectively. Top member 40 forms a top wall 42, two opposed downwardly-extending endwalls 44 and two opposed downwardly-extending sidewall portions 46. Bottom member 80 is in fitted engagement with top member 40 and forms a bottom wall 82 and two opposed upwardly-extending sidewalls 84 which, together with the downwardly-extending sidewall portions 46, and endwalls 44 of top member 40, define a substantially enclosed space within housing 22. Bottom member 80 includes tabs 86 at the terminal edge 88 of sidewalls 84. Bottom wall 82 of bottom member 80 further defines a socket window 90.

Figure 3:
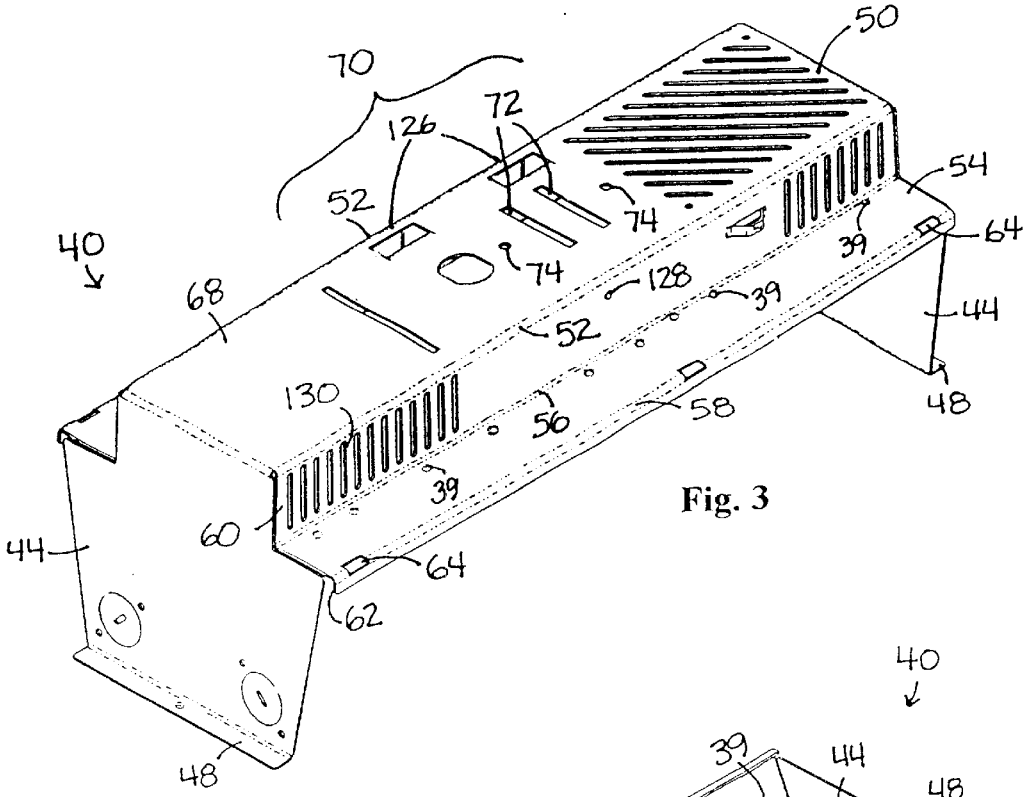
FIG. 3 is a top perspective view of the top member of the housing of the device of FIG. 1.
Figure 4:
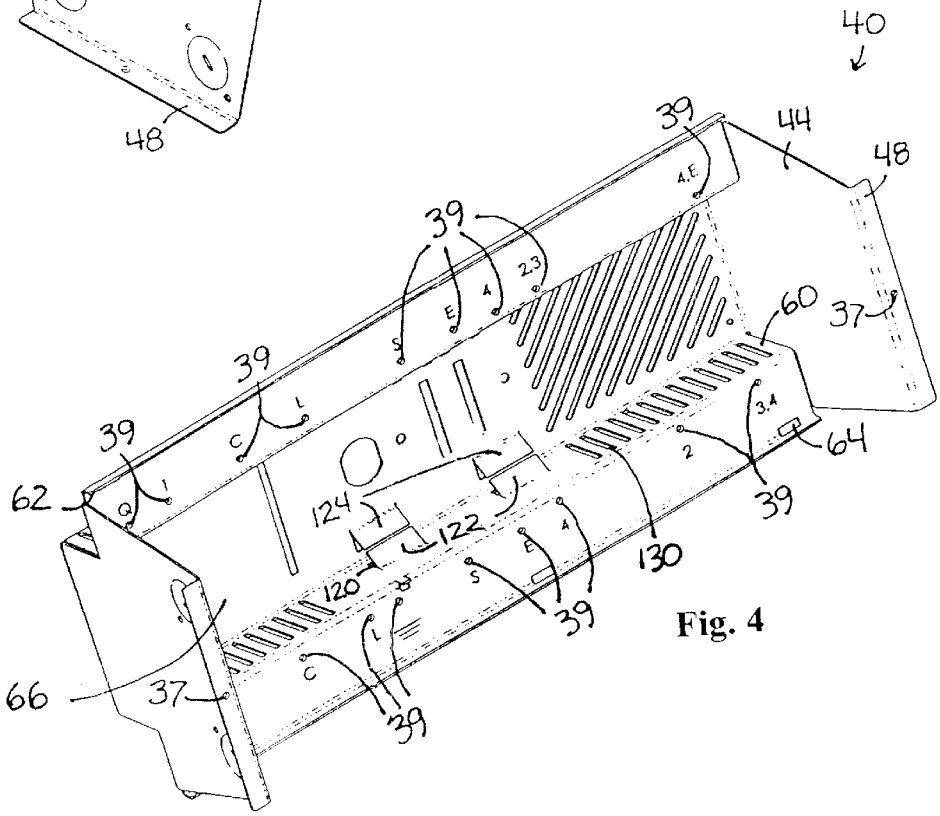
FIG. 4 is a bottom perspective view of the top member of the housing of the device of FIG. 1.

As seen in FIGS. 3 and 4, endwalls 44 of top member 40 terminate in end flanges 48 fastened to bottom wall 82 of bottom member 80 by fasteners 38. Top member 40 includes a central top-wall portion 50 having opposite edges 52 and a pair of lateral top-wall portions 54 below and on opposite sides of central top-wall portion 50. Lateral top-wall portions 54 each have an inner edge 56 and an outer edge 58. Downwardly-extending sidewall portions 46 of top member 40 include a pair of opposed upper sidewall portions 60 each extending downwardly from one of the opposite edges 52 of central top-wall portion 50 to inner edge 56 of one of lateral top-wall portions 54. Lateral top-wall portions 54 include a side flange 62 at its outer edge 58, and further define tab-receiving apertures 64 which are engageable with tabs 86 of upwardly-extending sidewalls 84 of bottom member 80.

Power-related components 24, 26 and 30, capacitor mounting strap 28, socket 34 and socket mount 32 are all enclosed within, and secured with respect to top member 40 of housing 22. Top member 40 of housing 22 provides a plurality of fastener receptors 39 to receive fasteners in threaded engagement therewith to secure ballast 24, capacitor 26, ignitor 30 and socket mount 32 to housing 22. Lamp-mounting socket 34 is secured to socket mount 32 and positioned with its lamp-receiving end substantially aligned vertically and horizontally with socket window 90.

Figure 8:
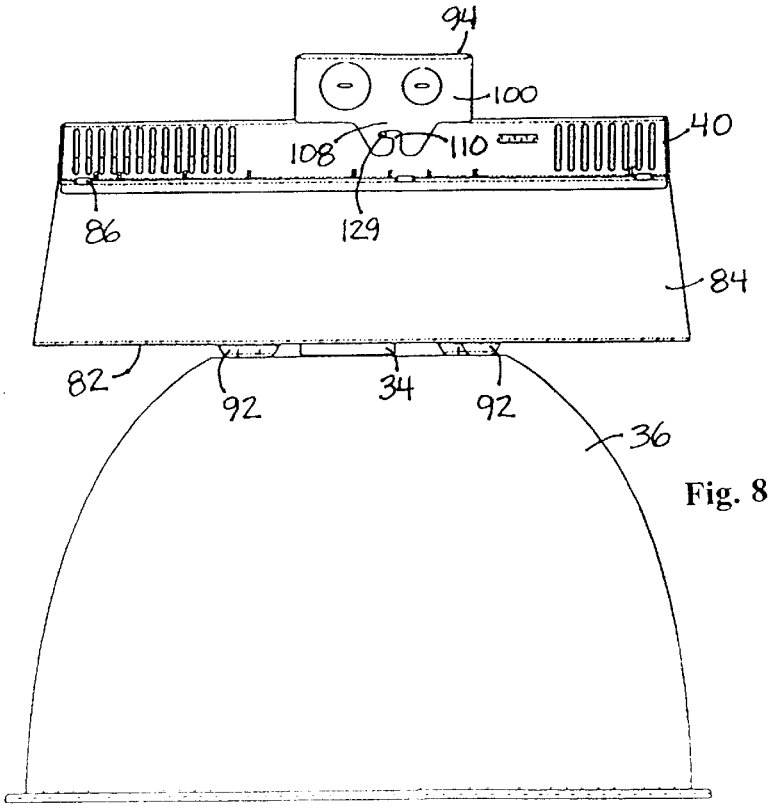
FIG. 8 is a front elevation of the device of FIG. 5.
Figure 9:
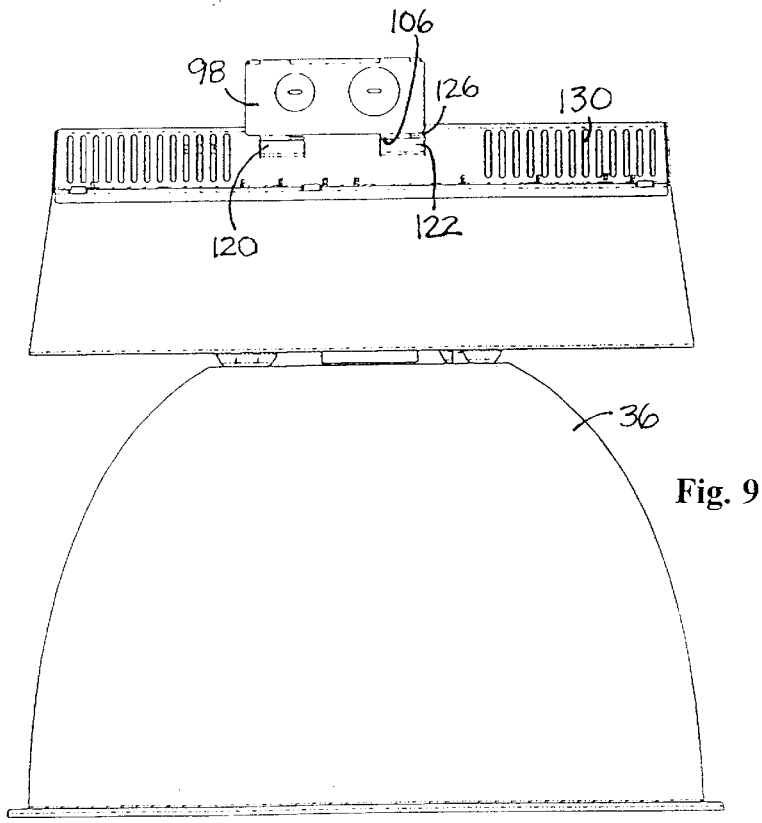
FIG. 9 is a rear elevation of the device of FIG. 5.

Referring to FIGS. 8 and 9, bottom wall 82 of bottom member 80 further includes a plurality of downward projections 92 around socket window 90. Reflector 36 is secured to housing 22 by attachment at downward projections 92 which forms an air-flow gap between bottom wall 82 and reflector 36. Housing 22 further includes a plurality of vents 130 at various locations on top member 40 and bottom member 80, particularly including at locations adjacent to heat-producing components, such as ballast 24.

As seen in FIGS. 3 and 4, central top-wall portion 50 of top member 40 has inner and outer surfaces, 66 and 68, respectively, and a center region 70 defining a pair of adjacent hanger-member apertures 72 therethrough. Central top-wall portion 50 further includes fastener apertures 74 on either side of hanger-member apertures 72.

A hanger member 76, FIGS. 1 and 2, is formed by a series of portions including (a) a base portion **76*a* having a threaded aperture 77 therethrough and secured to the inner surface 66 of central top-wall portion 50 adjacent to a chosen one of the hanger-member apertures 72, (b) a through portion 76*b* extending through the chosen hanger-member aperture 72, (c) an offsetting portion 76*c* extending from through portion 76*b* laterally along the outer surface and (d) an offset portion 76*d* extending from offsetting portion 76*c* and forming an upper support end 78. Hanger member 76 may be mounted with its offset portion 76*d* at whichever one of four positions is closest to the center of gravity of light fixture 20 as determined by the particular choice of power-related components within housing 22. Base portion 76*a* of hanger member 76 is secured to inner surface 66 of top wall 42 with a fastener extending through one of the fastener apertures 74 in top wall 42 and into threadable engagement with threaded aperture 77 of base portion 76*a* of hanger member 76**.

Referring now to FIGS. 5–7 and 11, a junction box 94 may be secured to housing 22 in position adjacent to center region 70 of top wall 50. Junction box 94 is generally box-shaped and includes a top surface 96, first and second sidewalls 98 and 100, respectively and opposed endwalls 102. Top surface 96 of junction box 94 defines a second pair of adjacent hanger-member apertures 104 therethrough, the second pair of hanger-member apertures 104 being positioned and arranged to provide at least three positions for mounting hanger member 76.

Figure 10:
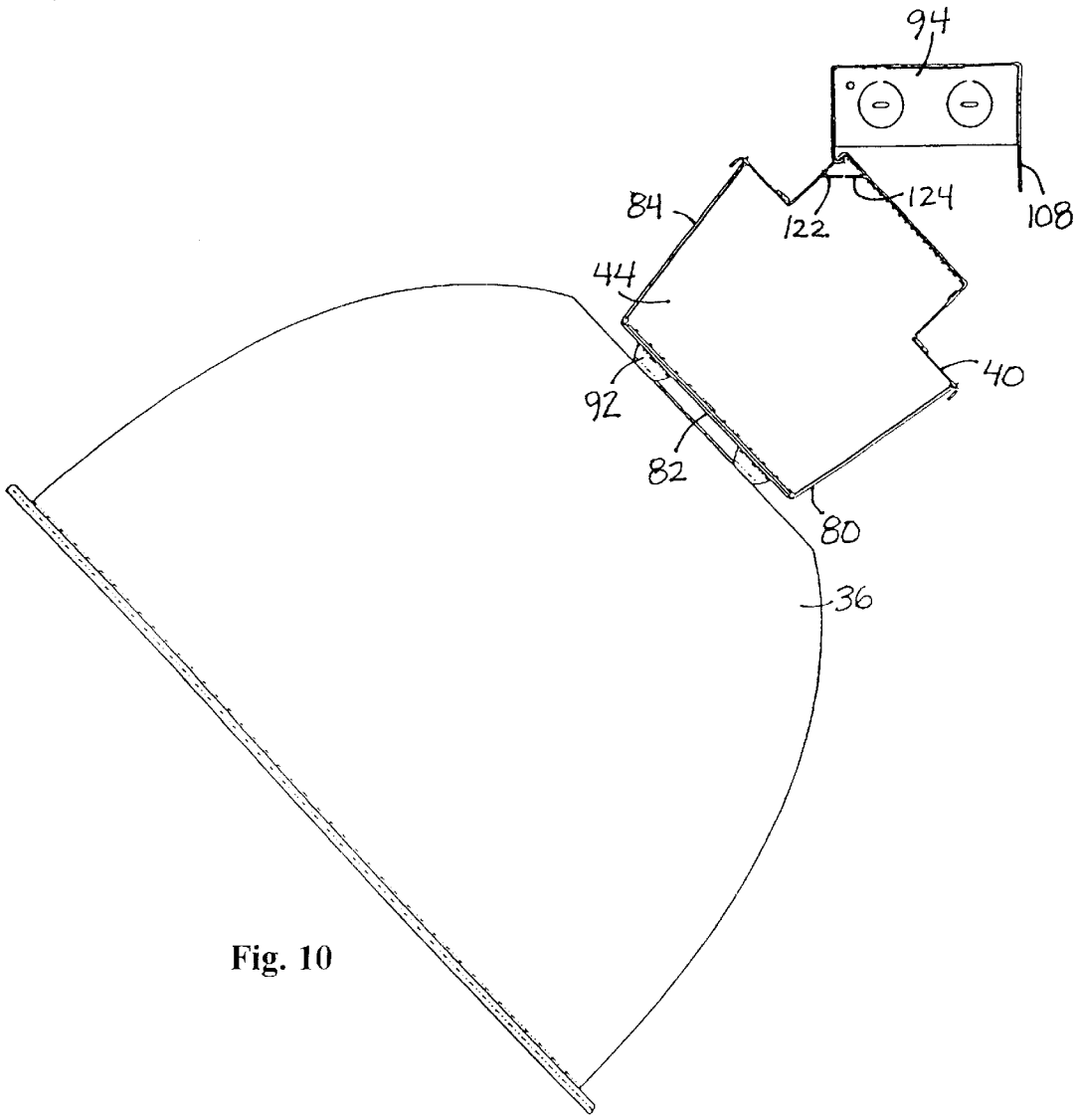
FIG. 10 is a side elevation of the device of FIG. 5 in hanging position during installation or service.
Figure 11:
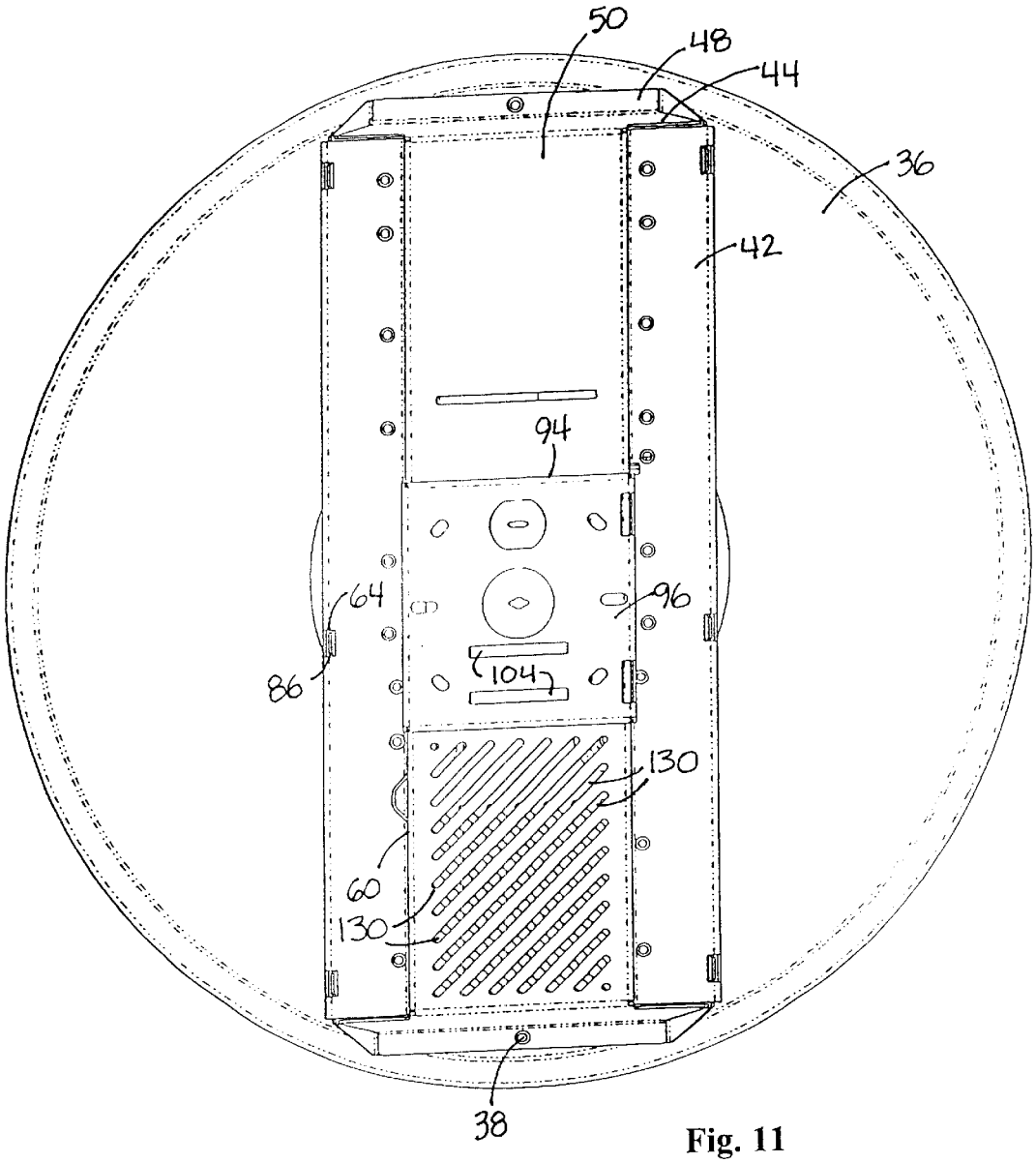
FIG. 11 is a top view of the device of FIG. 5.

Top member 40 of housing 22 further includes a spaced pair of hook-hold openings 120 at the common edge of one upper side-wall portion 60 and center region 70 of top wall 50. As best seen in FIGS. 4 and 10, hook-hold openings 120 are formed by first tongue portions 122 which are bent inwardly from upper side-wall portion 60 adjacent to top wall 50 and terminate upwardly in pivot edges 126. Junction box 94 includes a pair of hooks 106 which project from first sidewall 98 thereof. Hooks 106 each project into one of hook-hold openings 120 and upwardly around pivot edge 126 in top member 40 of housing 22. By such arrangement light fixture 20 can safely hang on junction box hooks 106 during installation or service without being fully secured to junction box 94.

Second tongue portions 124 are bent inwardly from center region 70 of top wall 50 adjacent to upper side-wall portion 60. The orientation of each pair of tongue portions 122 and 124, which are at 45° to the walls from which they are formed, are such that their distal ends are closely adjacent one another. By such arrangement, each pair of tongue portions forms a wire passageway to facilitate organization of internal wires and keep them from being damaged during assembly.

Figure 5:
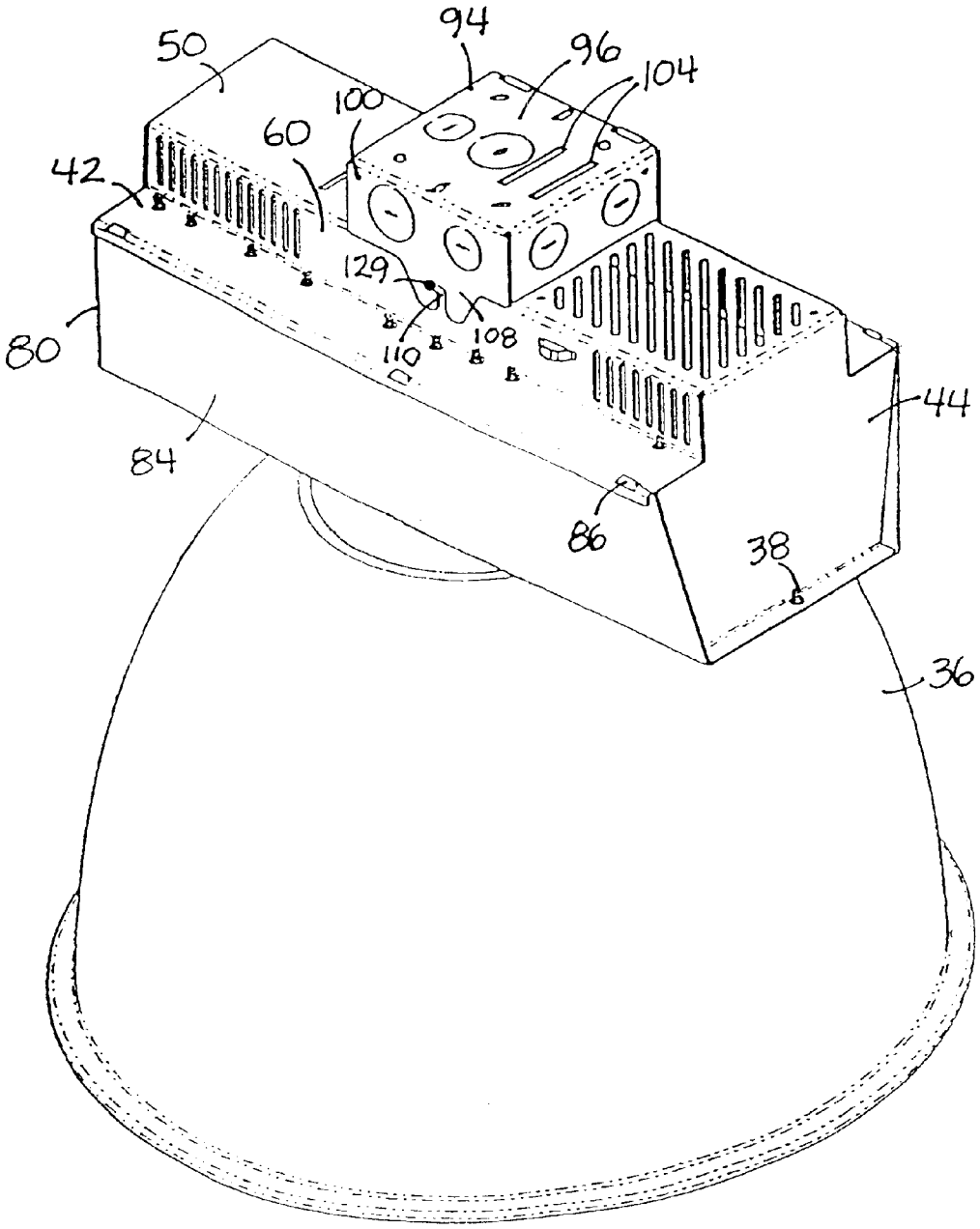
FIG. 5 is a perspective view of another embodiment of the device of FIG. 1.
Figure 6:
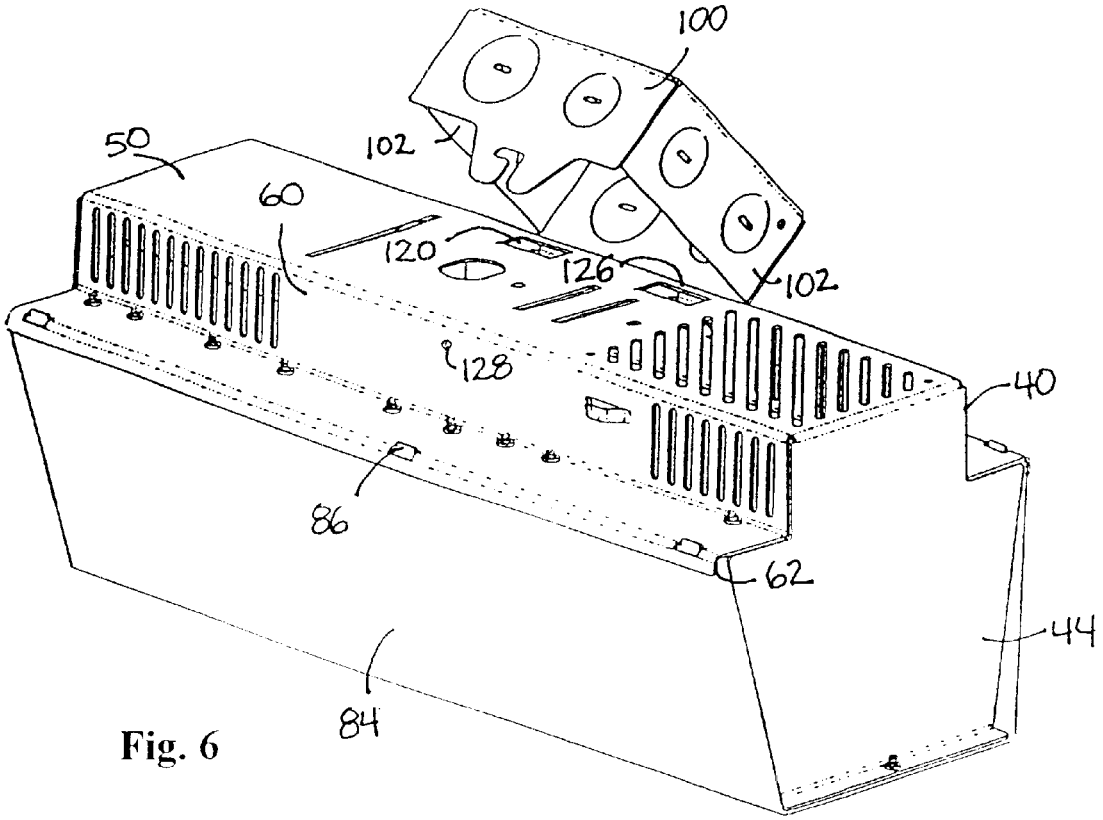
FIG. 6 is a perspective view of the housing and junction box of the device of FIG. 5.
Figure 7:
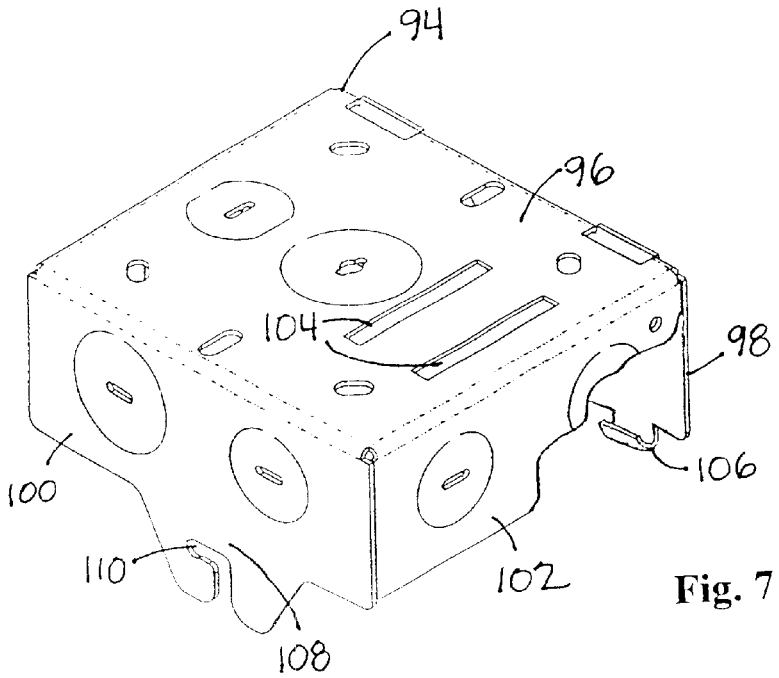
FIG. 7 is a partial cut-away perspective view of the junction box of FIG. 5.

Second edge 100 of junction box 94 includes a tab 108 projecting downwardly forming an inverted J-shaped fastener-engaging slot 110. A fastener-engaging aperture 128 is located opposite hook-hold apertures 120 on upper side-wall portion 60 of top member 40 and receives a fastener 129 in threadable engagement therewith to secure junction box 94 to housing 22, as seen in FIGS. 5–7.

FIG. 12 illustrates the method of manufacture of overhead industrial light fixture 20.

Before assembly, top member 40 and bottom member 80 are formed, preferably by sheet metal stamping and bending operations. Thereafter, assembly involves first placing top member 40 in inverted orientation on a work support structure 132, which may be a table or an assembly-line surface. Then, ballast 24 is placed at its assigned location bridging central top-wall portion 50 and secured to lateral top-wall portions 54 with fasteners (not shown) threadably engaged with aligned fastener-receptors 39. Capacitor 26 is secured to top member 40 between upper sidewall portions 60 by capacitor mounting strap 28 which is attached to lateral top-wall portions 54 at its assigned location, such attachment being by means of fasteners threadably engaged with certain of the fastener-receptors 39 which are aligned therewith. Ignitor 30 is secured to lateral top-wall portions 54 by attachment of fasteners to certain aligned fastener-receptors 39. All of such attachment is by engagement of fasteners in a common downward direction with certain of the fastener-receptors 39 in lateral top-wall portions 54.

Socket mount 32 is secured to lateral top-wall portions 54 by attachment of fasteners in the aforementioned common downward direction to certain aligned fastener-receptors 39. Socket mount 32 supports lamp-mounting socket 34 within housing 22.

Assembly continues by placement of bottom member 80, in an inverted orientation, on top member 40. Bottom member 80 is then secured to top member 40 by fasteners 38 which engage fastener-receptor 37. This substantially completes assembly of light fixture 20.

Reflector 36 can be attached to light fixture 20 while preparing for installation at a job site. In some cases, however, reflector 36 may be attached to light fixture 20 immediately upon completion of attachment of bottom member 80 to top member 40. If this is done, reflector 36, in an inverted orientation, is secured to downward projections 92 of bottom wall 82 using fasteners engagable with fastener-receptors 93 formed on downward projections 92, in the aforementioned common direction.

When assembly is completed, light fixture 20 is removed from work support structure 132 and is ready for packaging and shipment.

The sheet metal used in forming top member 40 and bottom member 80 is of a gauge sufficient to provide structural integrity but allow the required bending and stamping operations. Acceptable power-related components and other components used in manufacture of light fixture 20 are known to those skilled in the art. The weights, shapes and sizes of such components, including the reflector, vary greatly, and are fully accommodated by the hanger mounting system described above.

The low profile which is made possible by recessing socket 32 into housing 22 allows the vertical dimension of housing 22 to be as low as 4.5 to 6 inches, even when using electrical components which are standard in overhead industrial light fixtures.

While the principles of this invention have been described in connection with specific embodiments, it should be understood clearly that these descriptions are made only by way of example and are not intended to limit the scope of the invention.

What is claimed is:

1. A method for making an overhead industrial light fixture having a housing, power-related components secured within the housing, and a socket on a socket mount secured to the housing, comprising:

forming a top member having a horizontal top wall with fastener-receptors therein and an inside surface, the top wall including at least one horizontal top-wall portion;

forming a bottom member for fitted engagement with the top member;

placing the top member on a work support structure in inverted orientation;

placing each of the power-related components on the top-wall inside surface;

securing the power-related components to the inside surface by engagement of fasteners in a common direction with a set of the top-wall fastener-receptors;

placing the bottom member on the top member in inverted orientation;

securing the bottom member to the top member to substantially complete assembly of the fixture; and removing the fixture from the support structure.

2. The method of claim 1 further including:

placing the socket mount on the top-wall inside surface; and securing the socket mount to the inside surface by engagement of fasteners in the common direction with another set of the top-wall fastener-receptors.

3. The method of claim 1 wherein the power-related components include at least a ballast and a capacitor.

4. The method of claim 1 wherein the securing of the bottom member to the top member is by engagement of fasteners in the common direction with additional fastener-receptors in the top member.

5. The method of claim 4 further including:

placing the socket mount on the top-wall inside surface; and securing the socket mount to the inside surface by engagement of fasteners in the common direction with another set of the top-wall fastener-receptors.

6. The method of claim 1 wherein the top-member fastener-receptors are threaded holes and the fasteners engaged therewith are screws.

7. The method of claim 1 wherein the bottom member includes a horizontal bottom wall having an outside surface and a plurality of bottom-wall fastener-receptors therein, and the method further comprises:

placing a reflector on the outside surface of the bottom wall in inverted orientation; and securing the reflector to the bottom member by engagement of fasteners in the common direction with the bottom-wall fastener-receptors.

8. The method of claim 7 wherein the securing of the bottom member to the top member is by engagement of fasteners in the common direction with additional fastener-receptors in the top member.

9. The method of claim 8 wherein the top-member fastener-receptors are threaded holes and the fasteners engaged therewith are screws.

10. The method of claim 9 wherein the bottom-wall fastener-receptors are threaded holes and the fasteners engaged therewith are screws.

11. The method of claim 7 wherein the bottom-wall fastener-receptors are downward projections included in the bottom wall.

12. The method of claim 11 wherein the forming of the bottom member includes stamping to form the projections.

13. The method of claim 1 wherein the forming of the top member includes forming a central top-wall portion and a pair of lateral top-wall portions which are on opposite sides thereof and vertically offset therefrom, the top-wall fastener-receptors being on the lateral top-wall portions such that the securing of each of the power-related components and the socket mount is by engagement of fasteners with the fastener-receptors on both of the lateral top-wall portions.

14. The method of claim 13 wherein:

the forming of the top member further includes forming downwardly-extending sidewall portions which are integral with the top-wall portions, the downwardly-extending sidewall portions including two opposed endwalls each extending downwardly from the top wall and terminating in an end flange, the end flanges having additional fastener-receptors; and the forming of the bottom member includes forming a bottom wall and upwardly-extending sidewall portions which are integral with the bottom wall and which, together with the downwardly-extending sidewall portions, complete sidewalls for the housing, the bottom wall having fastener holes therein aligned with the fastener-receptors in the end flanges of the top-member sidewall portions.

15. The method of claim 14 wherein:

the forming of the top member includes bending a piece of sheet metal to form the junctures between the top wall and sidewall portions thereof, and the forming of the bottom member includes bending another piece of sheet metal to form the junctures between the top wall and sidewall portions thereof.

16. The method of claim 14 wherein the securing of the bottom member to the top member is by engagement of fasteners in the common direction with the fastener-receptors in the end flanges of the top-member sidewall portions.

17. The method of claim 1 wherein:

the forming of the top member includes bending a piece of sheet metal; and the forming of the bottom member includes bending another piece of sheet metal.

18. A method for making an overhead industrial light fixture having a housing, power-related components secured within the housing, and a socket on a socket mount secured to the housing, comprising:

forming top and bottom housing members for fitted engagement with one another to form the housing, each of the housing members having a horizontal wall with an inside surface, the horizontal surface of a first of the housing members having fastener-receptors therein;

placing on a work support structure the first housing member with its inside surface facing substantially upwardly;

placing the power-related components on the inside surface of the first housing member and securing them thereto by engagement of fasteners in a common direction with a set of the fastener-receptors;

placing the second of the housing members on the first housing member in its fitted engagement therewith;

securing the second housing member to the first housing member to substantially complete assembly of the fixture; and removing the fixture from the support structure.

19. The method of claim 18 further including placing the socket mount on the inside surface of the first housing member and securing it thereto by engagement of fasteners in the common direction with another set of the fastener-receptors.

20. The method of claim 19 wherein the securing of the second housing member to the first housing member is by engagement of fasteners in the common direction with additional fastener-receptors in the first housing member.

* * * * *